US011904208B2

(12) United States Patent
Washington

(10) Patent No.: US 11,904,208 B2
(45) Date of Patent: Feb. 20, 2024

(54) SYSTEMS AND METHODS FOR CLIMATE CONTROL ROOM

(71) Applicant: Corey Washington, East Lansing, MI (US)

(72) Inventor: Corey Washington, East Lansing, MI (US)

( * ) Notice: Subject to any disclaimer, the term of this patent is extended or adjusted under 35 U.S.C. 154(b) by 177 days.

(21) Appl. No.: 17/347,679

(22) Filed: Jun. 15, 2021

(65) Prior Publication Data

US 2021/0402258 A1 Dec. 30, 2021

Related U.S. Application Data

(60) Provisional application No. 63/043,962, filed on Jun. 25, 2020.

(51) Int. Cl.

| | |
|---|---|
| ***A63B 24/00*** | (2006.01) |
| ***A63B 22/02*** | (2006.01) |
| ***F24F 5/00*** | (2006.01) |
| ***F24F 11/89*** | (2018.01) |
| ***A63B 22/06*** | (2006.01) |
| ***F24F 120/14*** | (2018.01) |

(52) U.S. Cl.

CPC ..... *A63B 24/0087* (2013.01); *A63B 22/02* (2013.01); *A63B 22/0605* (2013.01); *F24F 5/0089* (2013.01); *F24F 11/89* (2018.01); *A63B 2220/72* (2013.01); *A63B 2225/50* (2013.01); *F24F 2120/14* (2018.01)

(58) Field of Classification Search

CPC . F24F 11/89; F24F 2120/14; A63B 2213/003; A63B 2213/001; A63B 24/0087; A63B 2220/72; G06V 40/23; H05B 47/115; A61N 2005/0615; A61N 5/0614

See application file for complete search history.

(56) References Cited

U.S. PATENT DOCUMENTS 9,715,242 B2 7/2017 Pillai et al.
10,123,738 B1 * 11/2018 Kokolis ..... A61B 5/4818

(Continued)

FOREIGN PATENT DOCUMENTS

CN 110612947 A 12/2019
EP 2058031 A1 * 5/2009 ..... A63B 22/00
JP 2006136651 A * 6/2006

OTHER PUBLICATIONS

New Atlas (FitWet Jet Bike, C.C. Weiss, Oct. 9, 2012) (Year: 2012).*

(Continued)

*Primary Examiner* — Schyler S Sanks

(74) *Attorney, Agent, or Firm* — Harness, Dickey & Pierce PLC

(57) ABSTRACT

Climate control room includes systems and sensors associated therewith. A further aspect includes programmed software instructions which include obtaining data of a user of the climate control room from the one or more sensors, raising a core body temperature of the user by a predetermined threshold based on the obtained data; and determining whether the core body temperature of the user has been raised by the predetermined threshold for a predetermined time period. The programmed software instructions may also set an ultraviolet light intensity level based on the obtained data.

16 Claims, 5 Drawing Sheets

(56) References Cited

U.S. PATENT DOCUMENTS

| | | | | |
|---|---|---|---|---|
| 2005/0085876 | A1* | 4/2005 | Alfredo | A61N 5/0614 607/94 |
| 2008/0103029 | A1 | 5/2008 | De Figueiredo Silva | |
| 2009/0253554 | A1* | 10/2009 | McIntosh | A63B 21/00 482/4 |
| 2014/0148706 | A1* | 5/2014 | Van Treeck | F24F 11/64 600/474 |
| 2016/0201933 | A1* | 7/2016 | Hester | F24F 11/48 700/276 |
| 2016/0310776 | A1 | 10/2016 | Smith | |
| 2017/0361125 | A1* | 12/2017 | Lakios | A61N 5/0614 |
| 2019/0130156 | A1* | 5/2019 | Yun | G06V 40/1318 |

OTHER PUBLICATIONS

JP2006136651A Translation (Year: 2006).*
Weiss, C., "The FitWet Jet Bike combines an exercise bike and a hot tub," New Atlas (Oct. 9, 2012).

* cited by examiner

SYSTEMS AND METHODS FOR CLIMATE CONTROL ROOM

CROSS-REFERENCE TO RELATED APPLICATION

This application claims the benefit of U.S. provisional patent application Ser. No. 63/043,962 filed Jun. 25, 2020, which is incorporated by reference herein.

FIELD

The present disclosure relates to a climate control room and more particularly to systems and methods for controlling the climate control room.

BACKGROUND AND SUMMARY

Studies have shown that climate is important to the cardiovascular health of humans. That is, people who were exposed to greater amounts of sunlight and heat, or who exercised in the heat, were less susceptible to cardiovascular issues (e.g., cardiovascular disease). People often use climate control rooms as a trade-off for lack of sunlight or cold temperatures outdoors especially during times when sunlight or warmth is not as accessible (e.g., winter season). Conventional climate control rooms such as saunas provide an environment where users are exposed to elevated temperatures. However, such climate rooms do not provide temperatures tailored to meet specific physiological needs of the user over specified periods of time. Furthermore, such climate control rooms do not provide ultraviolet light, which is also important for reducing the risk cardiovascular disease.

In accordance with the present invention, a climate control room is provided. In one aspect, the climate control room includes systems and sensors associated therewith. Another aspect provides systems and sensors associated with a climate control room and a programmable controller or processor configured to execute instructions stored in a nontransitory computer-readable medium. A further aspect includes programmed software instructions which include obtaining data of a user of the climate control room from the one or more sensors, setting an ultraviolet light intensity level and raising a core body temperature of the user by a predetermined threshold based on the obtained data; and determining whether the core body temperature of the user has been raised by the predetermined threshold for a predetermined time period. In another aspect, a controller or processor obtains data of a user of the climate control room, sets an ultraviolet light intensity level and raises a core body temperature of the user by a predetermined threshold based on the data, and determines whether the core body temperature has been raised by the predetermined threshold for a predetermined time period.

The systems according to the present disclosure are advantageous over conventional methods of controlling climate control rooms. For example, the systems account for particular characteristics of the user, which provide adequate heat to the user for a proper time period. Furthermore, the systems provide ultraviolet light to the user based on the user's skin tone, which further reduces the risk of cardiovascular disease.

Additional advantages and features of the present invention can be ascertained from the following description and claims taken in conjunction with the appended drawings.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Exemplary embodiments will now be described more fully with reference to the accompanying drawings.

Figure 1:
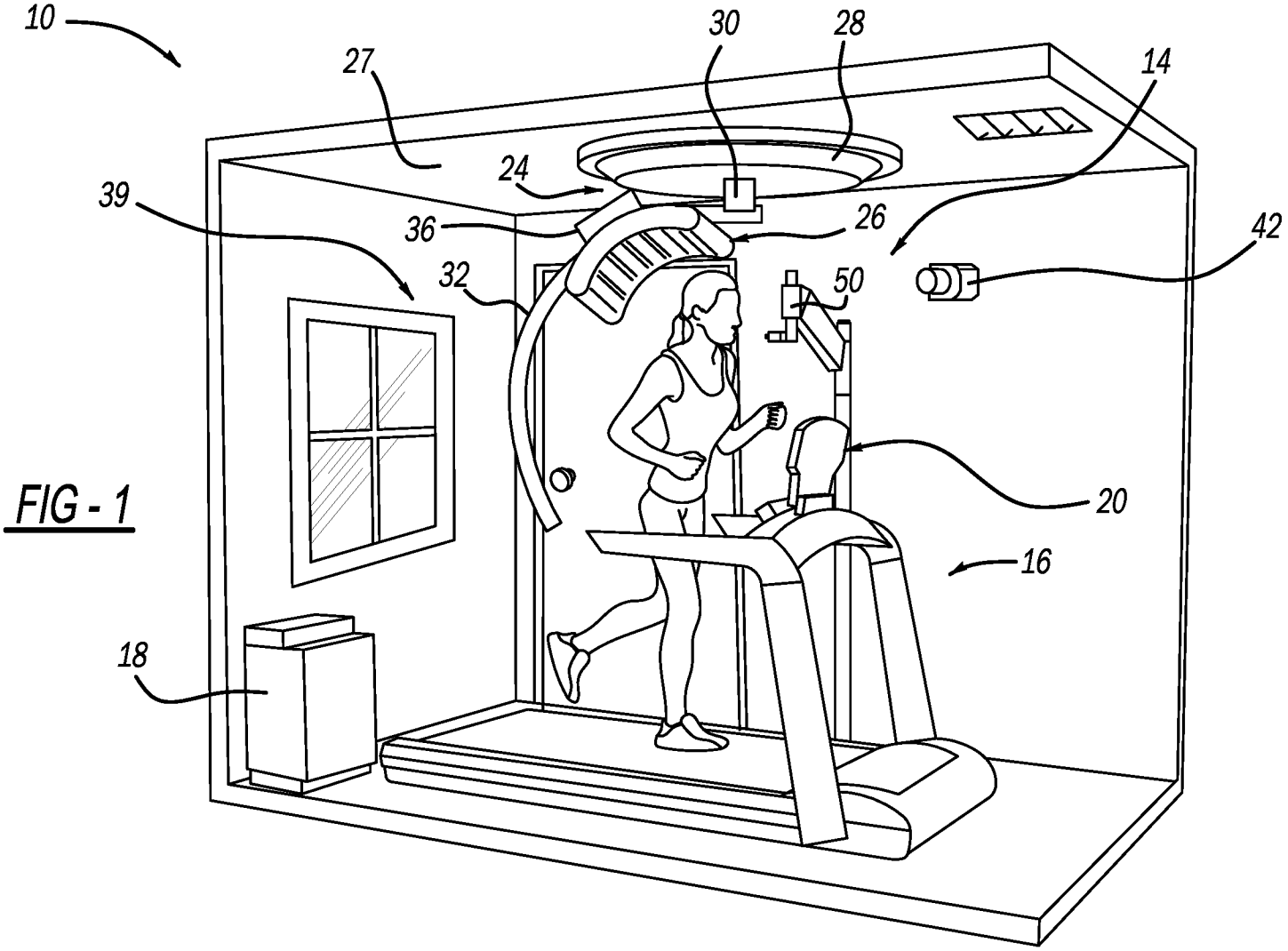
FIG. 1 is a perspective view showing an exemplary climate control room according to the present disclosure.
Figure 2:
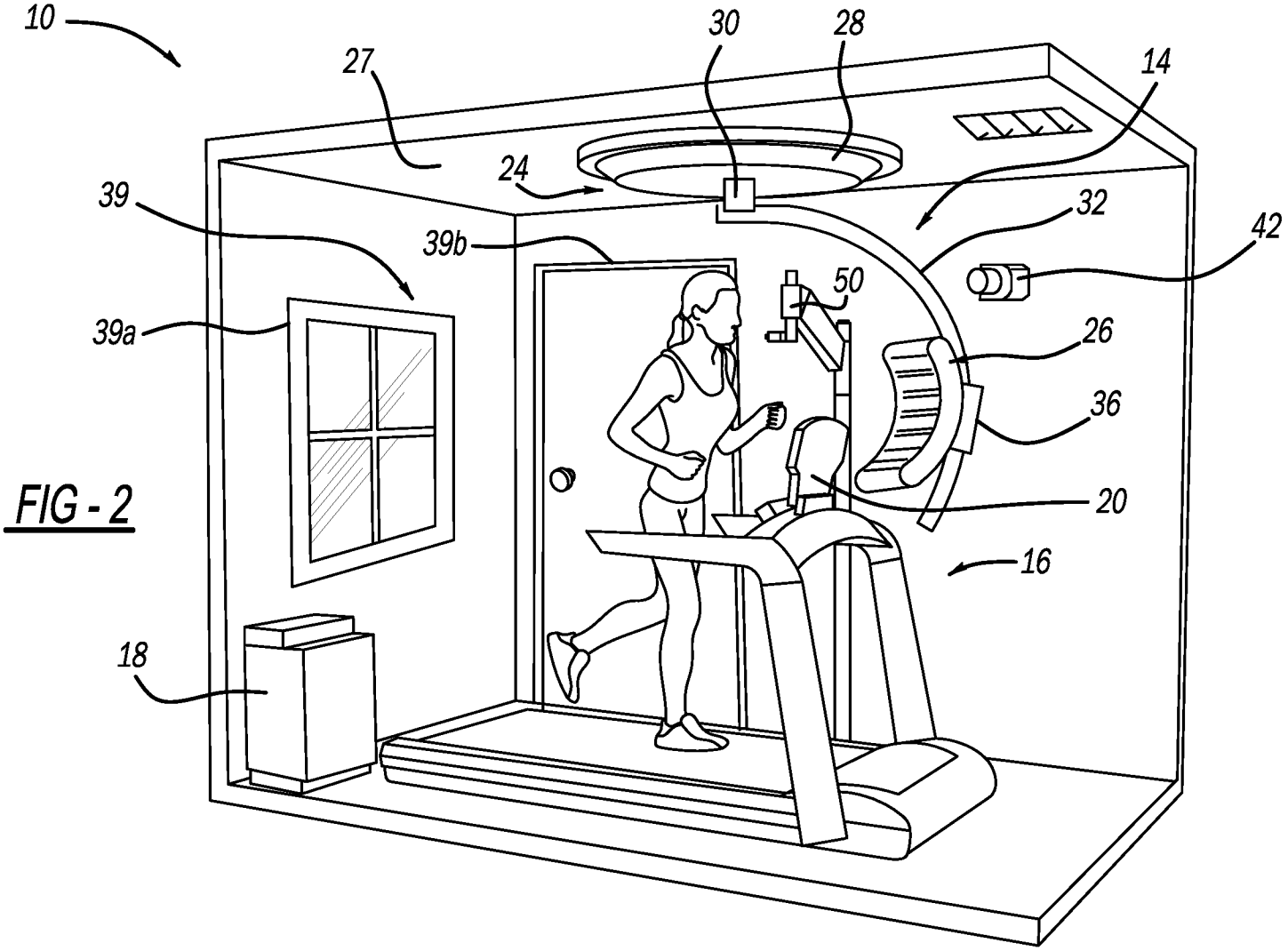
FIG. 2 is another perspective view showing the exemplary climate control room.
Figure 3:
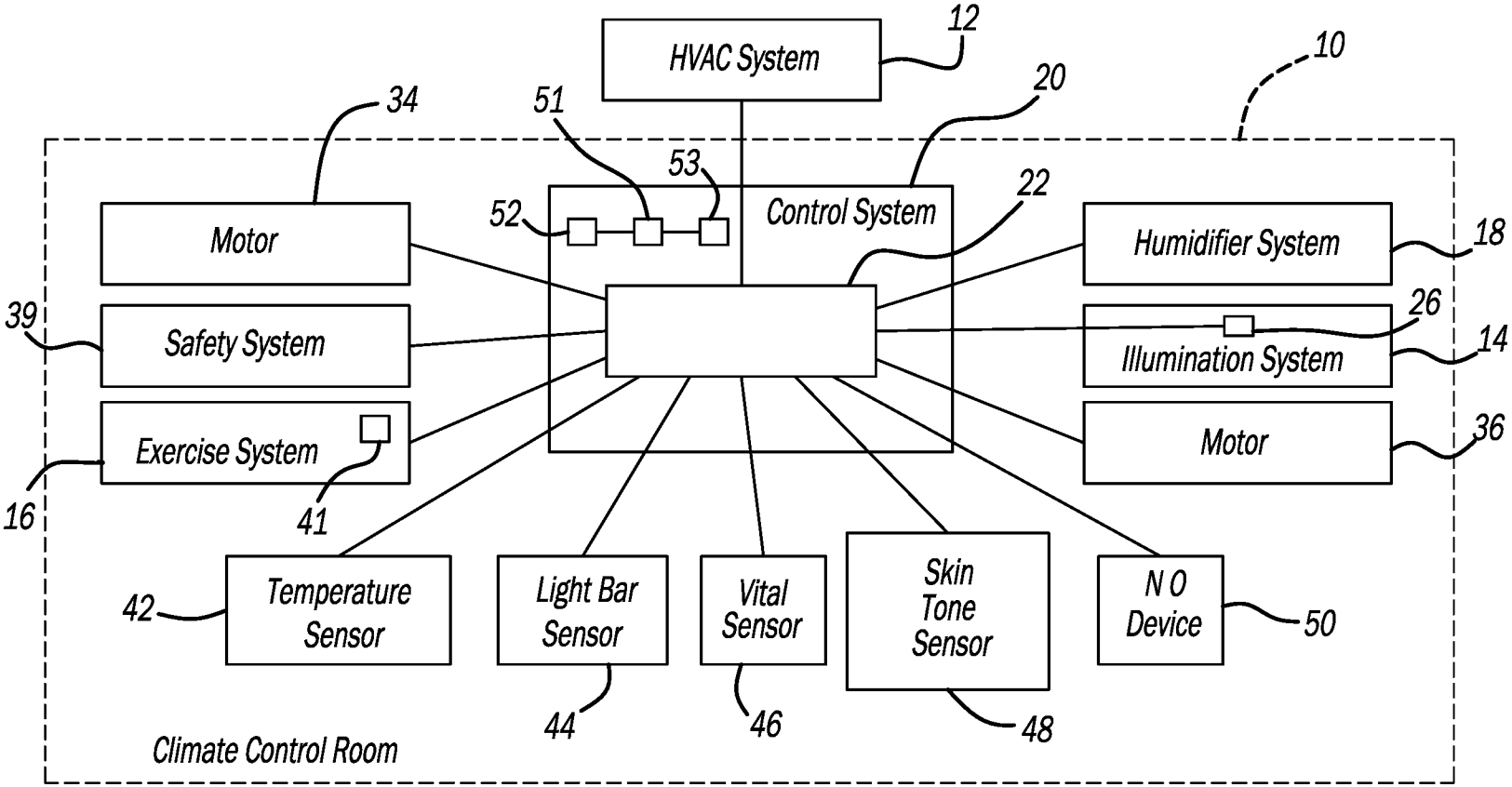
FIG. 3 is a functional block diagram showing systems associated with a climate control room.

FIGS. 1-3 show a climate control room 10 which includes systems that assist in improving health and wellness of an occupant of climate control room 10. The systems disposed in or otherwise associated with climate control room 10 may assist in improving cardiovascular health, for example, of an occupant or user of climate control room 10. For example, the systems may increase the core body temperature of a user for a predetermined time period while exposing the user to light (e.g., ultraviolet (UV) light), both of which increase nitric oxide (NO) bioavailability in the user and improve cardiovascular health. Climate control room 10 includes a heating, ventilation and air conditioning (HVAC) system 12 (FIG. 3), an illumination system 14, an exercise system 16, a humidifier system 18 and a control system 20.

HVAC system 12 and control system 20 are configured to, using software application 22 on the control system 20, communicate via wireless communication protocol so that HVAC system 12 provides heating, ventilation and cooling to climate control room 10. The wireless communication protocol includes an internet, Wi-Fi, Bluetooth®, or cellular connection or any other wireless communication protocol, for example. For example, HVAC system 12 and control system 20 communicate with each other over the internet via, a Wi-Fi connection to a Wi-Fi router located in or associated with climate control room 10. In this way, a user of climate control room 10 can control the temperature of climate control room 10 via HVAC system 12 using software application 22 on control system 20. This can be done by the user setting the temperature to a predetermined value (e.g., 70 degrees Fahrenheit) using the software application 22. In another configuration, the user can enter into software application 22 user characteristics (e.g., height, weight, age, etc.) or exercise goals which in turn sets the temperature to a calculated value. The HVAC system will include the capacity to move air through the climate room in order to achieve a specific wind speed that can be used to control the temperature gradient at the surface of the users skin, which will affect the heat experienced by the user and rate of evaporation of sweat from the surface of the user's skin.

Illumination system 14 is disposed within climate control room 10 and includes a coupling 24 and an illumination source 26, such as an LED light or group of lights. Coupling 24 is attached to a ceiling 27 of climate control room 10 and includes a mount 28, a pivot 30 and an arm 32. Mount 28 is coupled to ceiling 27 and provides stability for illumination system 14. Pivot 30 is rotatably coupled to mount 28 and is configured to rotate relative to mount 28 via an electric motor 34 (FIG. 3). Furthermore, motor 34 is in communication with software application 22 of control system 20 such that operation (e.g., power) of motor 34 can be controlled via control system 20. Arm 32 has an arcuate or semicircular shape, and is rotationally fixed to pivot 30 such that rotation of pivot 30 causes corresponding rotation of arm 32.

When energized, motor 36 causes illumination source 26 to slide back and forth along arm 32. Motor 36 is in communication with software application 22 of control system 20 such that operation (e.g., power) of motor 36 can be controlled via control system 20. Motor 36 includes a drive mechanism operatively operable to drive illumination source 26 along a length of arm 32 (i.e., between its opposing ends). In this way, illumination source 26 may traverse the length of arm 32 while arm 32 is rotating. Drive mechanism may be a rack and pinion, a gear system or a pulley device, for example.

Illumination source 26 is coupled to arm 32 and motor 36, and is operable between an ON mode and an OFF mode. When illumination source 26 is in the ON mode, illumination source 26 is configured to emit ultraviolet ("UV") and Visible ("Vis") light to a user of climate control room 10. When in the ON mode, an intensity level of the light may be varied. The light emitted to the user improves the health and wellness of the user.

Illumination source 26 is in communication with control system 20 via, for example, an internet, Wi-Fi, Bluetooth®, or cellular connection or any other wireless communication protocol. For example, illumination source 26 communicates with control system 20 over the internet via a Wi-Fi connection to a Wi-Fi router located in or associated with climate control room 20.

Exercise system 16 is disposed within climate control room 10 and is in communication with software application 22 of control system 20 such that operation (e.g., intensity level) of exercise system 16 can be controlled via control system 20. Exercise system 16 also includes a sensor 41 (FIG. 3) that is configured to measure a parameter indicative of a weight (or mass) of the user of exercise system 16. Exercise system 16 shown in FIGS. 1 and 2 is a treadmill. In some configurations, exercise system 16 may be an elliptical, exercise bike, rowing machine, weight system or any other exercise equipment for working out.

Humidifier system 18 is associated with climate control room 10 (e.g., disposed within climate control room 10) and is in communication with software application 22 of control system 20 such that operation of humidifier system 16 can be controlled via control system 20. In some configurations, the user may, using software application 22, operate humidifier system 16 to increase or decrease the humidity in climate control room 10. This can be done by the user setting the humidity level to a predetermined value using software application 22. In another configuration, the user can enter into software application 22 user characteristics (e.g., height, weight, age, etc.) or exercise goals such that the computer controller automatically sets and varies the humidity level to one or more calculated values throughout one or more periods of time during the exercising.

A safety system 39 is associated with climate control room 10 and is in communication with software application 22 of control system 20. Safety system 39 includes one or more windows 39*a* that are movable between closed and open positions and one or more doors 39*b* that are movable between closed and open positions. That is, control system 20 may operate to automatically move the one or more windows 39*a* and/or the one or more doors 39*b* between the closed and open positions based in part on actual real-time sensed values corresponding to the user's characteristics. For example, if the user's core body temperature is sensed to exceed a predetermined or calculated temperature value or threshold, control system 20 may move one or more windows 39*a* and/or one or more doors 39*b* from the closed position to the open position, allowing the escape of artificially increased humidity or heat, to decrease the core body temperature of the user.

As shown in FIGS. 1-3, first sensor 42 is associated with climate control room 10 and is in communication with software application 22 of control system 20. First sensor 42 is configured to measure a core body temperature of the user and communicate the core body temperature to control system 20. For example, first sensor 42 may be an infrared sensor that is attached to a wall of climate control room 10 and is capable of measuring the core body temperature of the user from a distance. In another example, first sensor may be a thermocouple, smartwatch or thermometer that contacts the skin of the user and is capable of measuring the core body temperature of the user and communicating the core body temperature to control system 20. This data is used at least in part to determine the temperature and/or exercise program necessary to raise the core body temperature of the user to a predetermined temperature for a predetermined time period. First sensor 42 may measure the core body temperature of the user continuously or intermittently.

As shown in FIG. 3, second sensor 44 is associated with the climate control room 10 and is in communication with software application 22 of control system 20. Second sensor 44 is configured to measure an amount of skin exposure of the user and communicate this data to control system 20. Second sensor 44 may be an optical or light sensor, for example, disposed within climate control room 10 and capable of measuring an amount of skin exposure of the user. This data is used at least in part to determine the temperature and/or exercise program necessary to raise the core body temperature of the user to a predetermined temperature for a predetermined time period or the intensity of UV and Vis light to obtain a fixed exposure for the whole body. For example, a user having 75% of their skin exposed may radiate more heat from their body while in the climate control room 10 then a user having 40% of their skin exposed. In this way, the temperature and/or exercise program of the user having 75% of their skin exposed may be increased as compared to the user having 40% of their skin exposed.

Third sensor 46 is associated with the climate control room 10 and is in communication with software application 22 of control system 20. Third sensor 46 is configured to measure vital characteristics (e.g., blood pressure, pulse rate, breathing rate, brain waves, or the like) of the user and communicate this data to control system 20. For example, third sensor 46 may be a vibration sensing transducer, inductive or optoelectronic plethysmography, a strain gage, a piezoresistive detector, a smartwatch, or the like, that contacts the skin of the user and is capable of measuring the vital characteristics and communicating this data to control system 20. This data is used at least in part to determine the temperature and/or exercise program necessary to raise the core body temperature of the user a predetermined threshold for a predetermined time period.

Fourth sensor 48 is associated with climate control room 10 and is in communication with software application 22 of control system 20. Fourth sensor 48 is configured to measure a skin tone or color of the user and communicate this data to control system 20. For example, fourth sensor 48 may be a Tele-spectroradiometers ("TSRs") or spectrophotometers ("SPs") instrument that automatically measures the skin tone of the user and communicates this data to the control system 20. In some configurations, the skin color of the user may be determined by a pantone skin color chip and entered manually into the control system 20. This data is used at least in part to determine the intensity level of the illumination device 26 for the user.

Device 50 is associated with the climate control room 10 and is in communication with software application 22 of control system 20. Device 50 is configured to measure a nitric oxide level of the user and communicates this data to control system 20. For example, the user may exhale or blow into the device 50, which then calculates the user's NO level. This data is used at least in part to determine whether or not the user is on pace with their NO output target.

Control system 20 (e.g., a tablet, a smartphone, a laptop, or other similar device) is associated with the climate control room 10 and includes a processor that is configured to execute instructions stored in a nontransitory computer-readable medium, such as a read-only memory ("ROM") and/or random-access memory ("RAM"). Control system 20 can be mounted on stationary exercise system 16. In some configurations, control system 20 can be mounted on a wall of climate control room 10. The functions of software application 22 of control system 20 is accessed using, for example, native application editions of the software and/or web applications of the software. Programmed instructions of software application 22 are stored in memory and run by a microprocessor of a computer controller 51. The user is able to input information and activate the software through an input keypad 52 connected to controller 51, and an optional output display screen 53 can display the status, input values, sensed values and the like.

As described above, control system 20 is in communication with HVAC system 12, illumination system 14, exercise system 16, humidifier system 18, motors 34, 36 and safety system 39, and controls operation of HVAC system 12, illumination system 14, exercise system 16, humidifier system 18, motor 34, 36 and safety system 39. Control system 20 is also in communication with sensors, 41, 42, 44, 46, 48 and device 50.

The nontransitory computer-readable medium of control system 20 may store information such as databases or lookup tables. For example, the databases and/or lookup tables may include exercise programs. In other examples, the databases and/or lookup tables may include UV intensity levels for populations on earth having no, minimal or reduced issues of cardiovascular disease for a variety of skin tones and/or genetic heritages.

Figure 4:
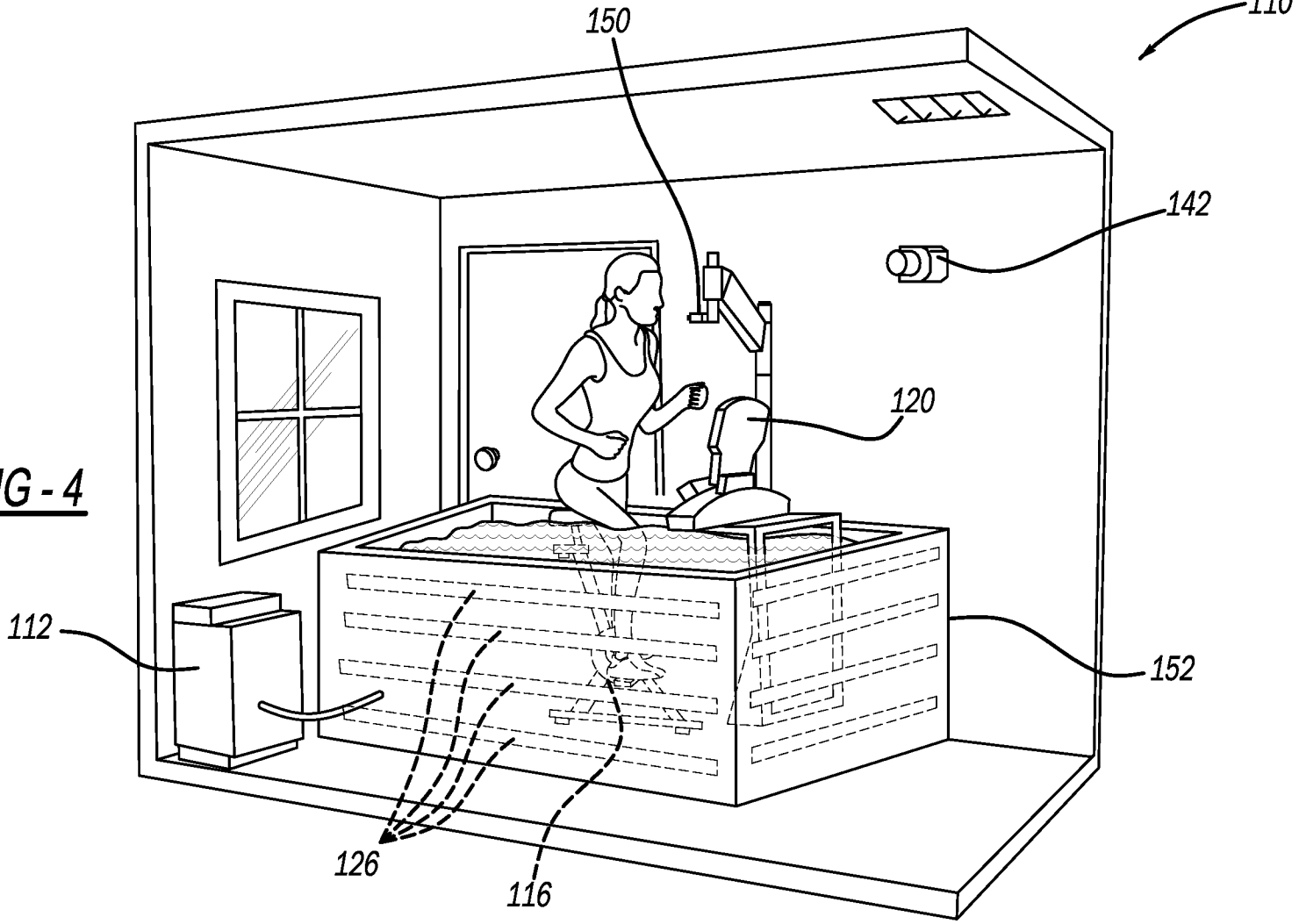
FIG. 4 is a perspective view showing an exemplary climate control room.

FIG. 4 shows a climate control room 110 including a heating system 112, an exercise system 116, a control system 120, illumination sources 126, a sensor 142, and a device 150. Exercise system 116, control system 120, illumination sources 126, sensor 142, and device 150 may be similar or identical to exercise system 16, control system 20, illumination source 26, sensor 42, and device 50, respectively, described above, and therefore, will not be described again in detail.

Heating system 112 is operable to heat the water supplied to a tub 152 disposed within climate control room 110. Exercise system 116 (e.g., an exercise bike) may be submersed within tub 152. Illumination sources 126 are coupled to tub 152 and are configured to emit light (e.g., UV light) to a user in tub 152.

Figure 5:
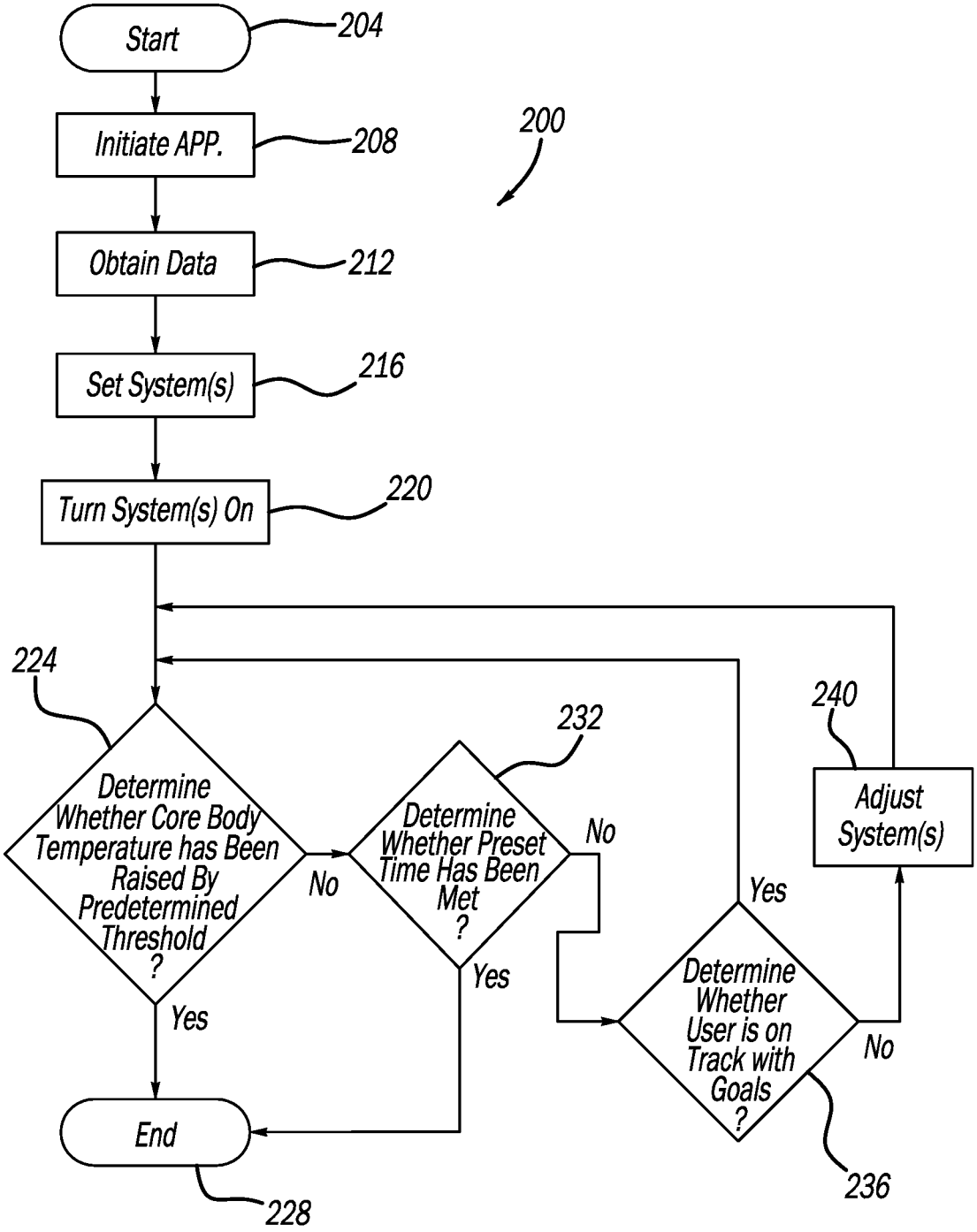
FIG. 5 is a flowchart showing control logic employed in the climate control room.

With reference to FIG. 5, a flowchart illustrating exemplary software control logic 200 is shown. The control logic 200 begins at 204 when, for example, control system 20 is turned on. At 208, control logic 200 initiates, using a processor of control system 20, software application 22. As an example, software application 22 may be initiated by opening a local copy of the application stored in the nontransitory computer-readable medium of the control system 20.

At 212, control logic 200 obtains, using software application 22, data from the user. This data may be a user's characteristics and goals. For example, the user's characteristics may include the user's height, weight, age, BP level, gender, skin color, core body temperature and/or race. In some configurations, the data may also include medical constraints of the user. The user's characteristics may be sensed via sensors 41, 42, 44, 46, 48 and/or entered manually into control system 20. The goals may include the user's target BP level, core temperature, target NO output, duration in climate control room 10 and/or exercise system 16 intensity. In some configurations, the goals may also include the user's target lipid level and arterial stiffness. The goals may automatically populate into control system 20 when the user enters their unique identifier information (e.g., name and birth date). In some configurations, the goals may be entered manually into control system 20.

At 216, control logic 200 sets, using the software application 22, systems 12-18 based on the obtained data and goals to raise the core body temperature of the user. For example, the temperature (via HVAC system 12) required to raise the core body temperature of a user may be lower for a user exercising for 20 minutes in climate control room 10 as compared to a user exercising for 10 minutes in climate control room 10. In another example, the humidity (via humidifier system 18) required to raise the core body temperature of a user may be lower for a user weighing 220 pounds as compared to a user weighing 150 pounds. The core body temperature of the user should be raised 1 to 3 degrees centigrade, and more preferably, 1.5 to 2.5 degrees centigrade.

In yet another example, an intensity level of illumination source 26 is set based on the skin tone of the user. For example, the intensity level of illumination source 26 will be lower for a user with a lighter skin tone as compared to a user with a darker skin tone. In some configurations, the intensity level of illumination source 26 may be determined such that the user is getting the same or similar UV exposure, for example, as populations with no or reduced cardiovascular diseases and having the same genetic heritage and skin tone. In the event that there are no populations with reduced cardiovascular diseases based on the user's genetic heritage and skin tone, the intensity level of illumination source 26 may be estimated.

At 220, control logic 200 turns, using software application 22, systems 12-18 to an ON mode. At 224, control logic 200 determines, using software application 22, whether the core body temperature of the user has been raised by a predetermined threshold for a predetermined time period (e.g., 10 minutes). If the core body temperature of the user has been raised by a predetermined threshold for a predetermined time period, control logic 200 proceeds to 228; otherwise, control logic 200 proceeds to 232. At 228, control logic 200 turns, using software application 22, systems 12-18 to an OFF mode and ends.

At 232, control logic 200 determines, using software application 22, whether the preset time in climate control room 10 has been met. If the preset time in climate control room 10 has been met, control logic 200 proceeds to 228; otherwise, control logic 200 proceeds to 236. At 236, control logic 200 determines, using software application 22, whether the user is on track to meet their goals. If the user is on track to meet their goals, control logic 200 proceeds to 224; otherwise, control logic 200 proceeds to 240.

At 240, control logic 200 adjusts, using software application 22, the settings of systems 12, 16, 18 to facilitate raising the core body temperature of the user. For example, the temperature of climate control room 10 may be increased and/or the humidity of the climate control room may be increased. In another example, the intensity of exercise system 16 may be increased. Control logic 200 then proceeds to 224.

It should be understood that the control logic 200, using software application 22, may automatically move windows 39*a* and/or doors 39*b* from the closed position to the open position if the core body temperature spikes above a preset threshold prior to 1) the core body temperature of the user being raised by a predetermined threshold for a predetermined time period or 2) the preset time duration of the user in climate control room 10 being reached. It should also be understood that systems 12-18 may be automatically turned to an OFF mode if any user medical constraints are exceeded.

While various embodiments have been disclosed, other variations are envisioned. For example, heaters may be disposed within climate control room 10 in addition to, or instead of, HVAC system 12. In another example, control system 20 may graphically display places on earth that features similar temperatures that the user experiences while in climate control room 10. It should be understood that the user of the rooms 10, 110 should be wearing eye protection (e.g., face fitting googles) that filter out UV light almost entirely.

Furthermore, additional or different electronic components may be employed other than those specifically described. Variations are not to be regarded as a departure from the present disclosure, and all such modifications are intended to be included within the scope and spirit of the present invention.

What is claimed is:

1. A climate control system comprising:

(a) at least one sensor associated with a climate control room;

(b) an ultraviolet light being located in the climate control room and directed at the user;

(c) a motor coupled to the ultraviolet light and configured to: move the ultraviolet light relative to the climate control room, and locate the ultraviolet light substantially directly toward a user; and (d) a processor configured to execute programmed instructions stored in a nontransitory computer-readable medium, wherein the instructions are configured to:

(i) obtain data of a user of the climate control room from the sensor;

(ii) automatically raise a core body temperature or a body heat exposure of the user by a predetermined threshold based on the obtained data; and (iii) automatically determine whether the core body temperature or the body heat exposure of the user has been raised by the predetermined threshold for a predetermined time period.

2. The system of claim 1, wherein the motor being connected to and controlled by the processor, wherein the processor being further configured to energize the motor to move the ultraviolet light.

3. The system of claim 1, further comprising exercise equipment located in the climate control room, and the at least one sensor obtaining the data from the user while exercising on the exercise equipment, the at least one sensor measuring at least one of the following user characteristics: blood pressure, pulse rate, breathing rate, sweat production, or brain waves.

4. The system of claim 3, wherein the at least one sensor includes at least a second sensor mounted to a surface of the climate control room, and the at least the second sensor measuring the core body temperature of the user.

5. The system of claim 1, further comprising causing ultraviolet and visible light exposure in the climate control room based on the data to the processor.

6. The system of claim 5, further comprising a tub configured to hold water and an exercise device therein.

7. The system of claim 1, wherein the at least one sensor includes a Tele-spectroradiometer or a spectrophotometer communicating to the processor.

8. The system of claim 1, further comprising a skin tone input of the user being sent to the processor and the processor varying the ultraviolet light based at least in part on the skin tone input.

9. A climate control system comprising:

(a) an exerciser including a moveable user-contacting surface;

(b) a first sensor configured to measure a user skin tone;

(c) a second sensor configured to measure a user characteristic comprising at least one of: blood pressure, pulse rate, sweat production, breathing rate, or brain waves;

(d) at least a third sensor configured to measure a user temperature;

(e) a programmable controller configured to automatically vary an environmental condition based on the measurements from the sensors during use of the exerciser;

(f) a humidifier in communication with the controller and automatically varied by the controller based in response to at least one of the measurements;

(g) an ultraviolet light located substantially directed toward the exerciser;

(h) a climate control room within which the exerciser, the sensors and the controller are located;

(i) at least one of the sensors being mounted to a surface of the climate control room; and (j) a motor moving the ultraviolet light relative to the climate control room, energization of the motor being automatically controlled by the controller.

10. The system of claim 9, wherein the first sensor includes a Tele-spectroradiometer or a spectrophotometer communicating to the controller.

11. The system of claim 9, wherein the user skin tone measurement being sent to the controller, and the controller automatically varying a characteristic of the ultraviolet light based at least in part on the user skin tone measurement.

12. The system of claim 9, further comprising:

a heater in communication with the controller and automatically varied by the controller based in response to at least one of the measurements; and the exerciser being one of: a stationary bicycle, rowing machine, or a treadmill.

13. The system of claim 9, further comprising at least one of: a window or a door, automatically opened by the controller to allow heat to escape in response to at least one of the measurements.

14. The system of claim 9, wherein the user temperature includes a user core body temperature increase.

15. The system of claim 9, wherein the user temperature includes a user body heat exposure.

16. A method for using a climate control room comprising:

(a) sensing a user characteristic associated with the climate control room;

(b) automatically setting a light intensity level of an ultraviolet light and raising at least one of the following user features: a user core body temperature, sweat production, a user body heat exposure or an ultraviolet light exposure, by a predetermined threshold based on the sensed user characteristic;

(c) moving, using a motor, the ultraviolet light relative to the climate control room, wherein the ultraviolet light is located substantially directly toward the user;

(d) automatically determining whether the user feature has been raised by a desired threshold amount for a desired time period;

(e) sending a measurement of the user characteristic from a sensor to a programmable controller in the climate control room while a user is exercising on exercise equipment in the climate control room;

(f) automatically varying temperature in the climate control room by the controller in response to the measurement; and (g) automatically varying a characteristic of ultraviolet light in the climate control room in response to skin tone of the user while the user is exercising on the exercise equipment.

* * * * *